US005192232A

United States Patent [19]

Lenz et al.

[11] Patent Number: 5,192,232

[45] Date of Patent: Mar. 9, 1993

[54] ELECTRICAL CONNECTOR SYSTEM UTILIZING THIN MALE TERMINALS

[75] Inventors: William R. Lenz, Crestwood; Arvind Patel, Naperville; James T. Roberts, Oak Park; Jack J. Schafer, LaGrange, all of Ill.

[73] Assignee: Molex Incorporated, Lisle, Ill.

[21] Appl. No.: 912,922

[22] Filed: Jul. 13, 1992

[51] Int. Cl.[5] ..... H01R 13/00

[52] U.S. Cl. ..... 439/660

[58] Field of Search ..... 439/68-73, 439/660, 692, 693, 695, 696

[56] References Cited

U.S. PATENT DOCUMENTS

| | | | |
|---|---|---|---|
| 3,497,866 | 2/1970 | Patton, Jr. | 439/660 |
| 3,697,926 | 10/1972 | Krafthefer | 339/17 L |
| 3,986,766 | 10/1976 | Sochor | 439/660 |
| 4,420,215 | 12/1983 | Tengler | 339/176 R |
| 4,726,777 | 2/1988 | Billman et al. | 439/70 |

*Primary Examiner*—Joseph H. McGlynn
*Attorney, Agent, or Firm*—Stephen Z. Weiss

[57] ABSTRACT

An electrical connector system includes a first connector assembly having an insulative housing defining at least one cavity with a thin male terminal extending thereinto. A second connector assembly includes an insulative housing defining at least one cavity with a spring contact terminal located therein. The thin male terminal is engageable with the spring contact terminal upon mating of the connector assemblies. The first connector assembly includes a supporting wall for supporting one side of the thin male terminal, and the wall extends only partially along the length of the male terminal to leave an unsupported distal end of the terminal. The second connector assembly includes a preloading wall against which the spring contact terminal is biased for preloading the spring contact terminal. The distal end of the thin male terminal is insertable between the spring contact terminal and the preloading wall, with the preloading wall supporting the distal end of the male terminal on the one side thereof, upon mating of the connector assemblies. Therefore, the supporting wall of the first connector assembly and the preloading wall of the second connector assembly combine to provide support along a substantial length of the male terminal. Preferably, the preloading wall is configured to engage and provide support for the unsupported distal end of the thin male terminal before the male terminal engages the preloaded spring contact terminal.

8 Claims, 4 Drawing Sheets

ELECTRICAL CONNECTOR SYSTEM UTILIZING THIN MALE TERMINALS

FIELD OF THE INVENTION

This invention generally relates to the art of electrical connectors and, particularly, to an electrical connector system which includes a connector assembly having thin male terminals with unique supporting means for the terminals.

BACKGROUND OF THE INVENTION

In the electrical connector art, a common type of electrical connector system includes a pair of mating connectors generally of the "pin and socket" type. In other words, one connector assembly includes a plurality of male or pin-type terminals for engagement with a "socket" terminal of the mating connector assembly. The socket terminal may be an actual female socket or it may be of another configuration such as a spring or biased terminal for engaging the male terminal pin.

Male terminal "pins" may be formed or rolled of sufficient thickness to be self-supporting, particularly during mating with the socket or female terminal. On the other hand, it may be desirable to stamp and form the male terminal from thin sheet metal material for various cost and manufacturing purposes. Stamped and formed male terminals also are quite amenable for high density electrical connector systems.

One of the problems with thin male terminals, such as of the stamped and formed type, is that the terminals tend to bend or buckle during mating unless they somehow are sufficiently supported. Providing adequate support for the male terminals often results in the respective connector assembly, itself, being rather bulky or having a large envelope which is undesirable in the ever-increasing miniaturization of electronic components. For instance, the electrical connector assemblies may be used in printed circuit board applications wherein miniaturization is of a premium.

This invention is directed to solving these problems by providing an electrical connector system wherein the respective connector assembly which mounts the thin male terminals, as well as the complementary mating connector assembly, cooperate or combine to support the male terminals, particularly during mating or engagement with the female terminals of the complementary connector assembly.

SUMMARY OF THE INVENTION

An object, therefore, of the invention is to provide a new and improved electrical connector system having improved means for supporting thin male terminals, particularly during mating.

In the exemplary embodiment of the invention, the electrical connector system includes a first connector assembly having an insulative housing defining at least one cavity with a thin male terminal extending thereinto. A second connector assembly has an insulative housing defining a cavity with a spring contact terminal located therein. The thin male terminal is engageable with the spring contact terminal upon mating of the connector assemblies. The connector assemblies may be of the plug and receptacle type, such as a header assembly for mounting on a printed circuit board and for mating with a complementary receptacle connector.

The invention contemplates that the first connector assembly include a supporting wall for supporting one side of the thin male terminal, with the supporting wall extending only partially along the length of the male terminal to leave an unsupported distal end of the terminal. The second connector assembly includes a preloading wall against which the spring contact terminal is biased for preloading the spring contact terminal. The distal end of the male terminal is insertable between the spring contact terminal and the preloading wall, with the preloading wall supporting the distal end of the male terminal on the one side thereof. Therefore, the supporting wall of the first connector assembly and the preloading wall of the second connector assembly combine to provide support along a substantial length of the thin male terminal.

As disclosed herein, the thin male terminal is a stamped and formed component of sheet metal material. The supporting wall and the preloading wall of the respective connector assemblies have distal ends which are in close proximity to each other when the connector assemblies are mated. Therefore, the walls combine to provide support for the thin male terminal along substantially the entire length thereof.

The invention is shown herein as embodied in a header/receptacle connector system. The respective connectors have a plurality of respective terminals extending lengthwise of the connectors in two rows. The invention is made applicable with such a system by having the supporting wall of the first connector assembly to comprise a partition between pairs of transverse cavities into which pairs of the thin male terminals respectively extend, and the preloading wall of the second connector assembly comprises a partition between pairs of transverse cavities in which pairs of the spring contact terminals respectively are located. Mating pairs of the male terminals and spring contact terminals are spaced longitudinally of the connector assemblies.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
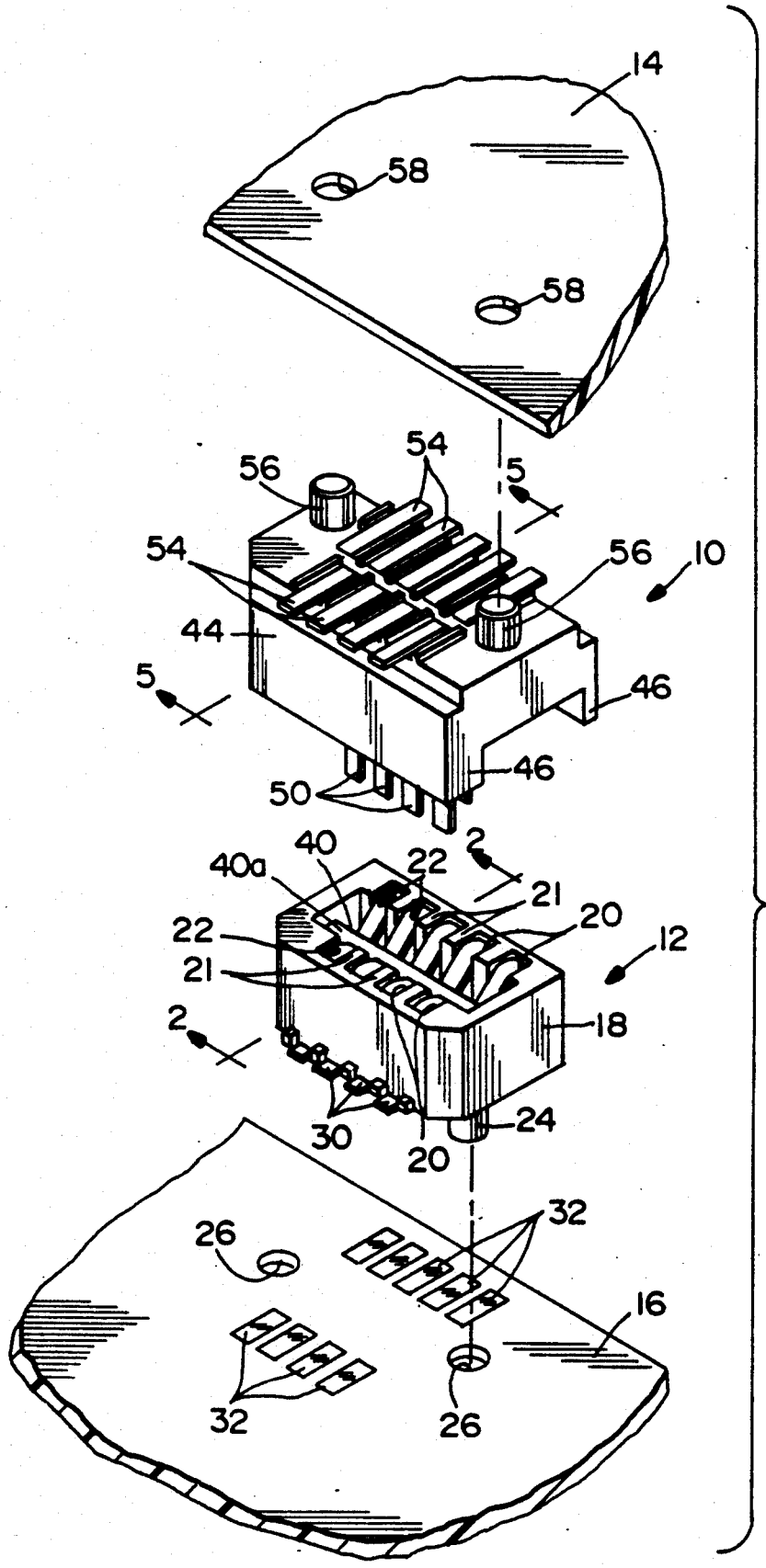
FIG. 1 is an exploded perspective view of an electrical connector system embodying the concepts of the invention.

Referring to the drawings in greater detail, and first to FIG. 1, the invention is embodied in an electrical connector system which includes a first connector assembly, generally designated 10, for mating with a second connector, generally designated 12. As disclosed herein, first connector assembly 10 is a male or header connector assembly for mounting on a printed circuit board 14. Second connector assembly 12 is a female or receptacle connector assembly for mounting on a printed circuit board 16. Hereinafter, connector assembly 10 will be referred to as the header connector, and connector assembly 12 will be referred to as the receptacle connector. However, it should be understood that the invention is equally applicable for incorporation in other types of mating connector assemblies wherein one of the connector assemblies mounts one or more thin male terminals.

Figure 3:
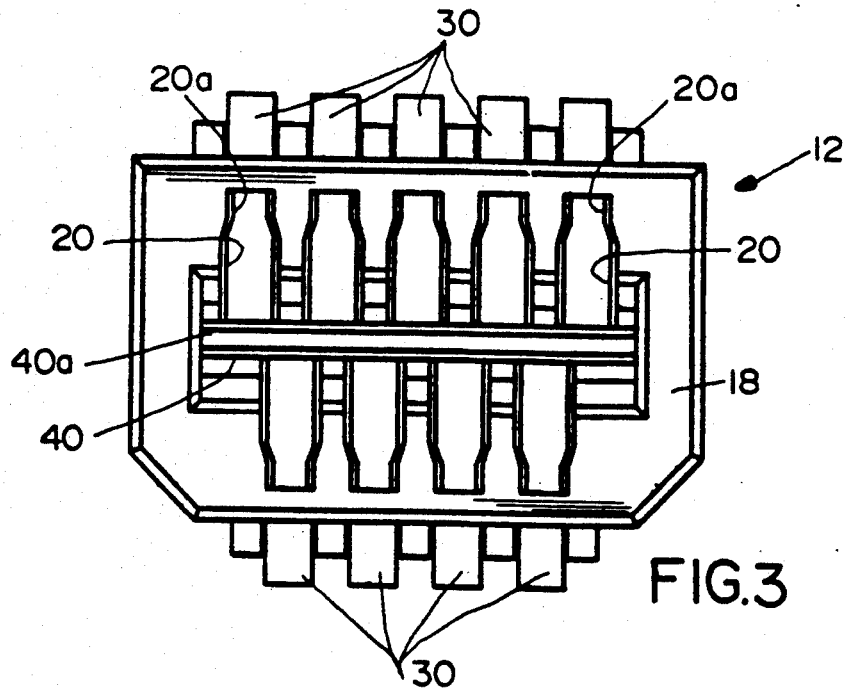
FIG. 3 is a top plan view of the receptacle connector assembly.
Figure 2:
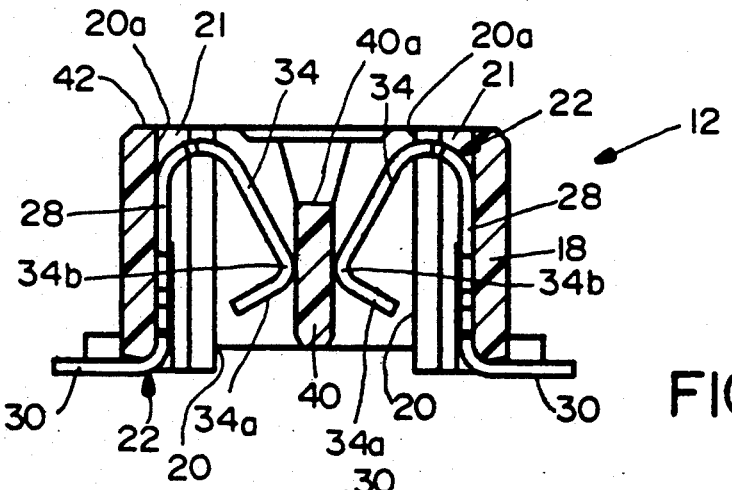
FIG. 2 is vertical section through the receptacle connector assembly, taken generally along line 2—2 of FIG. 1.
Figure 4:
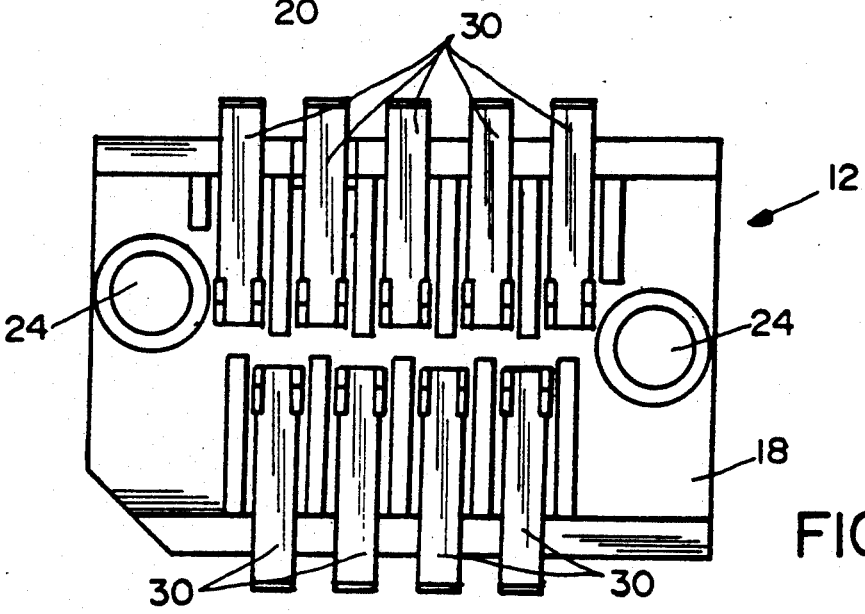
FIG. 4 is a bottom plan view of the receptacle connector assembly.

More particularly, referring to FIGS. 2–4 in conjunction with FIG. 1, receptacle connector 12 includes a dielectric or insulative housing 18 having a plurality of terminal-mounting cavities 20 for mounting a plurality of spring contact terminals, generally designated 22. As seen best in FIG. 2, the housing generally has transverse pairs of cavities 20 for receiving respective transversely disposed spring contact terminals 22, the pairs of cavities and terminals running along the length of the housing which is elongated as seen best in FIG. 1. Actually, the transverse cavities and respective terminals are staggered as seen in FIGS. 1, 3 and 4. Housing 18 also has a pair of mounting pegs 24 (FIG. 1) for positioning in a pair of mounting holes 26 in printed circuit board 16.

As seen best in FIG. 2, each spring contact terminal 22 includes an L-shaped mounting portion defining a mounting leg 28 for mounting in cavity 20 (as described in greater detail hereinafter), and a mounting or solder leg 30 for mounting onto printed circuit board 16 by soldering leg 30 to a respective circuit trace or contact pad 32 on printed circuit board 16 as seen in FIG 1. Each spring contact terminal 22 also includes a spring contact leg 34 bent downwardly from the top of mounting leg 28, as viewed in FIG. 2, and terminating in a bent distal end 34*a* which defines a contact elbow or point 34*b* which engages a respective male terminal of header connector 10, as described hereinafter.

Generally, spring contact terminals 22 are spring loaded within housing 18 of receptacle connector 12. Specifically, elbows 34*b* of spring contact legs 34 are self-biased against a preloading wall 40 which, in the construction of the receptacle connector herein, defines a partition between transverse cavities 20. It should be noted in FIG. 2 that an upper distal end 40*a* of preloading wall 40 is spaced below a top or mating surface 42 of housing 18. In other words, the preloading wall extends upwardly only partially of the cavity height.

Figure 5:
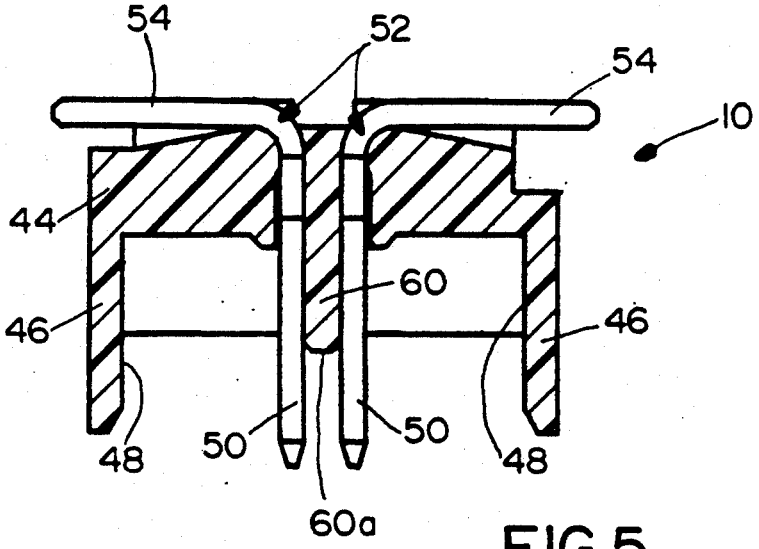
FIG. 5 is a vertical section through the header connector assembly, taken generally along line 5—5 of FIG. 1.

Referring to FIG. 5 in conjunction with FIG. 1, header connector 10 includes a dielectric or insulative housing 44 which is elongated and has a pair of side walls 46 defining cavities 48 (FIG. 5) into which thin male terminal legs 50 of a plurality of male terminals, generally designated 52, extend. Each male terminal 52 is generally L-shaped and includes solder legs 54 for soldering to contact pads or circuit traces (not shown) on the underside of printed circuit board 14. Housing 44 has a pair of mounting pegs 56 for mounting in a pair of mounting holes 58 in printed circuit board 14. Similar to preloading wall or partition 40 (FIG. 2) of receptacle connector 12, header connector 10 includes a central supporting wall or partition 60 which separates transverse cavities 48. Importantly, supporting wall 60 provides support for male terminal legs 60 on the opposing insides thereof as best seen in FIG. 5. Preferably, male terminals 52 are stamped and formed components of thin sheet metal material.

Figure 7:
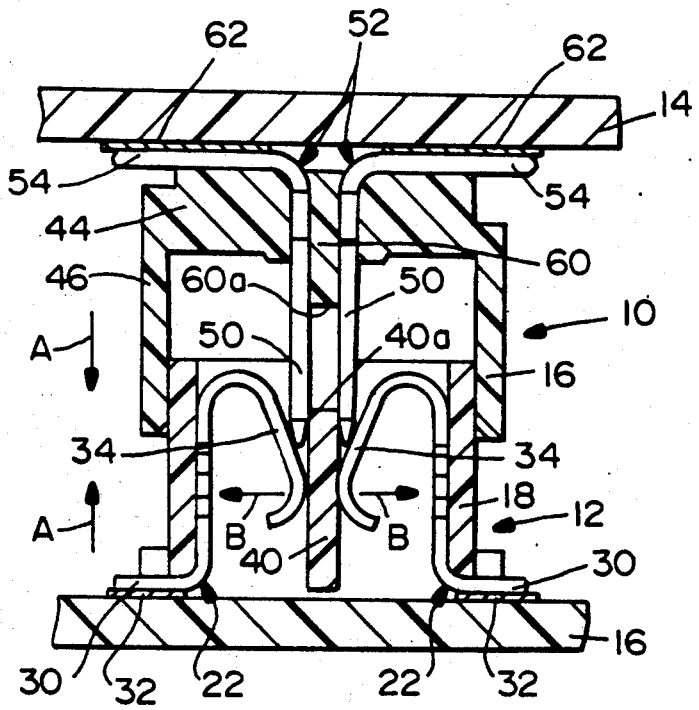
FIG. 7 is a section through the connector assemblies in an initial stage of mating.

It should be noted particularly in FIG. 5 that supporting wall 60 extends only partially along the length of male terminal legs 50 and terminates in a distal end or edge 60*a*. The supporting wall provides considerable support for the male terminal legs, but the wall leaves an unsupported distal end of each leg as seen in FIG. 5, for engaging or mating with spring contact terminals 22, as described below. More particularly, FIG. 7 shows header connector 10 mounted to printed circuit board 14, with solder legs 54 of male terminals 52 soldered to solder pads 62 on the underside of the printed circuit board. Receptacle connector 12 is mounted to printed circuit board 16, with solder legs 30 of spring contact terminals 22 soldered to solder pads 32 on the printed circuit board.

FIG. 7 shows header connector 10 and receptacle connector 12 in an initial stage of mating. It can be seen that housing 18 of the receptacle connector is sized for insertion between side walls 46 of housing 44 of header connector 10. In other words, the connectors are mateable in the direction of arrows "A". During this initial stage of mating, it can be seen that distal end 40*a* of preloading wall 40 of receptacle connector 12 is located between the distal ends of male terminal legs 50 before the ends of the legs begin biasing spring contact legs 34 of spring contact terminals 22 outwardly in the direction of arrows "B". Therefore, preloading wall 40 provides a dual function of not only preloading spring contact terminals 22, but the preloading wall provides a backing or support for the thin stamped and formed terminal legs of male terminals 52.

Figure 8:
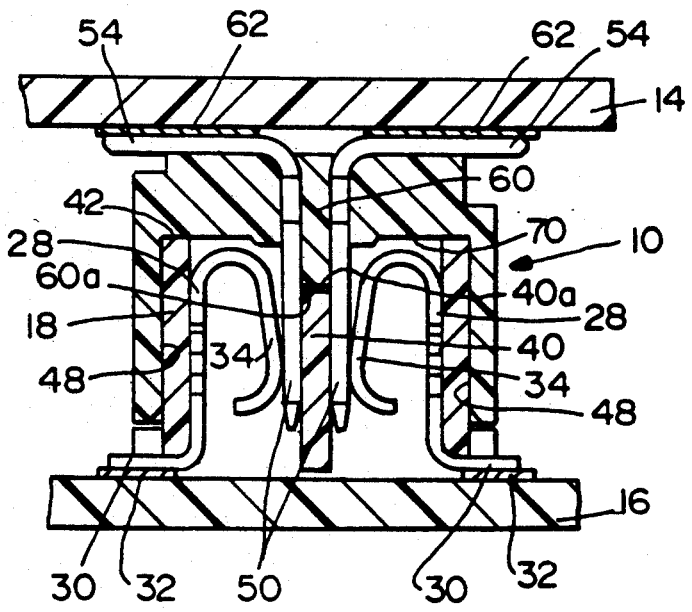
FIG. 8 is a view similar to that of FIG. 7, with the connector assemblies fully mated.

FIG. 8 shows header connector 10 and receptacle connector 12 in fully mated condition. It can be seen that distal end or edge 40*a* of preloading wall 40 of the receptacle connector is in close proximity to distal end or edge 60*a* of supporting wall 60 of the header connector. Therefore, the preloading wall and the supporting wall combine to provide support for the thin stamped and formed terminal legs 50 along substantially the entire lengths thereof. In this fully mated condition, mating surface 42 of receptacle connector housing 18 bottoms out against an interior wall 70 which defines the bottoms of cavities 48 in the header connector.

Figure 6:
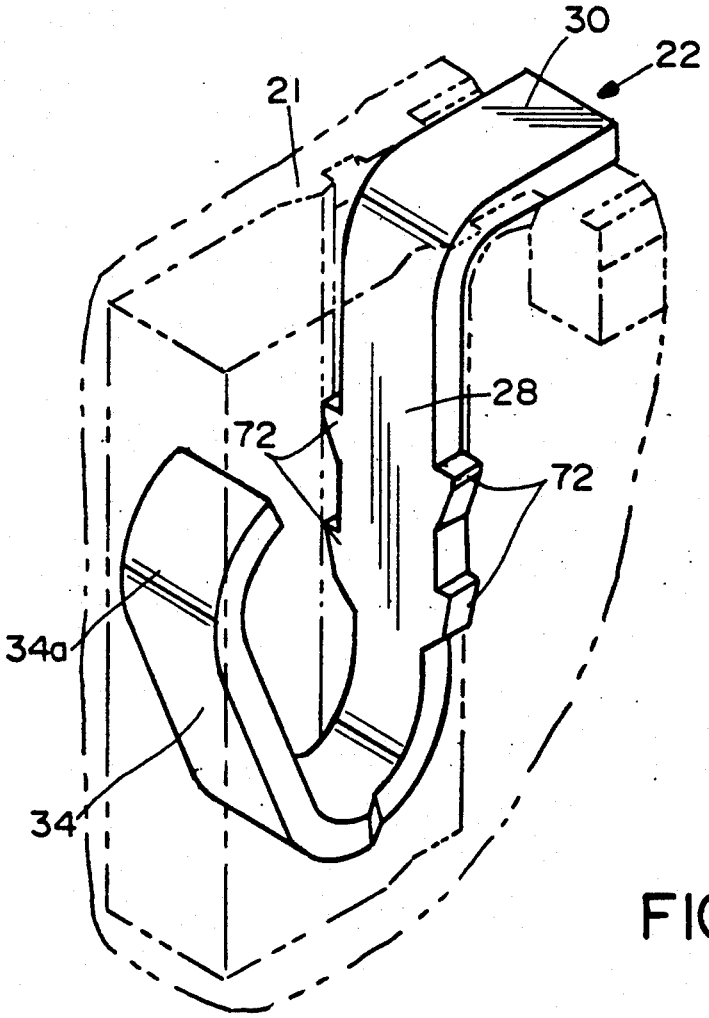
FIG. 6 is an enlarged perspective view of one of the spring contact terminals of the receptacle connector assembly, shown within one of the cavities thereof, the surrounding portions of the receptacle connector assembly being shown in phantom.

Lastly, FIG. 6 shows that each spring contact terminal 22 also is a stamped and formed component of sheet metal material. It should be noted that spring contact leg 34 is wider than the portion of the supporting leg 28 between the spring contact leg 34 and first pair of barbs 72. The supporting leg has two pairs of barbs 72 projecting outwardly from the sides thereof. Now, referring back to FIG. 3, it can be seen that each cavity 20 in receptacle connector housing 18 has a narrow portion 20*a* within which the narrow mounting leg 28 of each spring contact terminal 22 is mounted. Barbs 72 dig into the dielectric material of the housing in these narrowed portions of the cavities. In essence, the wider spring contact legs 34 provide a wider area for engagement by the male terminals, and the spring contact terminals can be stamped from a given width of material with narrower portion of the supporting leg 28 between the spring contact leg 34 and first pair of barbs which do not project outwardly a distance which is greater than the distance between sidewalls 21 which define the bounds of cavities 20.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector system which includes a first connector assembly having an insulative housing defining a cavity with a thin male terminal extending thereinto, and a second connector assembly having an insulative housing defining a cavity with a spring contact terminal located therein, the thin male terminal being engageable with the spring contact terminal upon mating of the connector assemblies, wherein the improvement comprises said first connector assembly including a supporting wall for supporting one side of the thin male terminal and extending only partially along the length of the male terminal to leave an unsupported distal end of the terminal, said second connector assembly including a preloading wall against which the spring contact terminal is biased for preloading the spring contact terminal, and the distal end of said thin male terminal being insertable between the spring contact terminal and the preloading wall, with the preloading wall supporting the distal end of the male terminal on said one side thereof, upon mating of the connector assemblies, whereby the supporting wall of the first connector assembly and the preloading wall of the second connector assembly combine to provide support along a substantial length of the thin male terminal.

2. In an electrical connector system as set forth in claim 1, wherein said supporting wall and said preloading wall have distal ends which are in close proximity to each other when the connector assemblies are mated, whereby the walls combine to provide support for the thin male terminal along substantially the entire length thereof.

3. In an electrical connector system as set forth in claim 1, wherein said supporting wall of the first connector assembly comprises a partition between a pair of said cavities into which a pair of said thin male terminals respectively extend, and said preloading wall of the second connector assembly comprises a partition between a pair of said cavities in which a pair of said spring contact terminals respectively are located.

4. In an electrical connector system as set forth in claim 1, wherein said thin male terminal comprises a stamped and formed component of sheet metal material.

5. In an electrical connector system as set forth in claim 1, wherein said preloading wall is dimensioned so that the distal end thereof engages and supports the distal end of the male terminal prior to engagement of the male terminal with the spring contact terminal during mating of the connector assemblies.

6. An electrical connector system, comprising:

a first connector assembly including an elongated insulative housing defining at least a pair of rows of cavities longitudinally thereof for mounting a plurality of thin male terminals respectively extending into the cavities, the housing having a supporting partition wall extending longitudinally thereof between the transverse rows of cavities, the partition wall supporting opposing sides of the thin male terminals and extending only partially along the length of the male terminals to leave unsupported distal ends of the terminals; and a second connector assembly having an elongated insulative housing defining at least two rows of transverse cavities with a plurality of spring contact terminals respectively located therein, the spring contact terminals being engageable by the thin male terminals upon mating of the connector assemblies, the housing of the second connector assembly including a preloading partition wall extending lengthwise thereof and between the transverse cavities, with the spring contact terminals being biased against the preloading partition wall for preloading the spring contact terminals, and wherein the distal ends of the male terminals are insertable between the spring contact terminals and the preloading wall upon mating of the connector assemblies, the preloading partition wall being configured for supporting the distal ends of the male terminals on said sides thereof before the male terminals engage the spring contact terminals, whereby the supporting partition wall of the first connector assembly and the preloading partition wall of the second connector assembly combine to provide support along a substantial length of the male terminals during mating of the connector assemblies.

7. The electrical connector system of claim 6 wherein said thin male terminals comprise stamped and formed components of sheet metal material.

8. The electrical connector system of claim 6 wherein said supporting partition wall and said preloading partition wall are configured to have distal ends which are in close proximity to each other when the connector assemblies are mated, whereby the walls combine to provide support for the thin male terminals along substantially the entire length thereof.

* * * * *